US007811070B2

(12) United States Patent
Nelson

(10) Patent No.: US 7,811,070 B2
(45) Date of Patent: Oct. 12, 2010

(54) PNEUMATIC VANE MOTOR WITH BY-PASS MEANS

(75) Inventor: Anders Urban Nelson, Älvsjö (SE)

(73) Assignee: Atlas Copco Tools AB, Nacka (SE)

( * ) Notice: Subject to any disclaimer, the term of this patent is extended or adjusted under 35 U.S.C. 154(b) by 148 days.

(21) Appl. No.: 11/916,926

(22) PCT Filed: Jun. 9, 2005

(86) PCT No.: PCT/SE2005/000872

§ 371 (c)(1),
(2), (4) Date: Dec. 7, 2007

(87) PCT Pub. No.: WO2006/132572

PCT Pub. Date: Dec. 14, 2006

(65) Prior Publication Data

US 2009/0016918 A1 Jan. 15, 2009

(51) Int. Cl.
*F04C 2/344* (2006.01)
*F01C 1/344* (2006.01)

(52) U.S. Cl. ..... 418/104; 418/133; 418/180; 418/270

(58) Field of Classification Search ..... 418/180, 418/181, 189, 15, 239, 104, 133, 270
See application file for complete search history.

(56) References Cited

U.S. PATENT DOCUMENTS

| | | | | |
|---|---|---|---|---|
| 3,426,648 | A * | 2/1969 | Fehlings | 418/181 |
| 3,835,934 | A * | 9/1974 | Schoeps et al. | 173/176 |
| 3,923,429 | A | 12/1975 | Schaedler et al. | |
| 5,769,617 | A * | 6/1998 | Glen | 418/15 |
| 6,068,461 | A * | 5/2000 | Haga et al. | 418/180 |
| 2004/0086374 | A1 | 5/2004 | Elsmark et al. | |
| 2004/0197218 | A1 * | 10/2004 | Wu et al. | 418/15 |

FOREIGN PATENT DOCUMENTS

JP 7-259503 A 10/1995

* cited by examiner

*Primary Examiner*—Thomas E Denion
*Assistant Examiner*—Mary A Davis
(74) *Attorney, Agent, or Firm*—Holtz, Holtz, Goodman & Chick, PC

(57) ABSTRACT

A pneumatic vane motor with a stator cylinder having an air inlet opening and an air outlet opening, a rotor eccentrically journalled in the cylinder and carrying a number of sliding vanes which divide the cylinder into moving cells, wherein the cylinder comprises a by-pass passage located between the air inlet opening and the air outlet opening and arranged to leak air from a pressurized working cell into a preceding cell before the working cell reaches the outlet opening, thereby using a preceding cell as an expansion volume for sound attenuation.

2 Claims, 3 Drawing Sheets

PNEUMATIC VANE MOTOR WITH BY-PASS MEANS

This application is a U.S. National Phase Application under 35 USC 371 of International Application PCT/SE2005/000872 filed Jun. 9, 2005.

FIELD OF THE INVENTION

The invention relates to a pneumatic vane motor of the type having a housing with a cylinder and a vane carrying rotor journalled in the housing in a eccentric disposition relative to the cylinder, wherein the vanes divide the cylinder into a number of moving cells each defined by a leading vane and a trailing vane.

BACKGROUND OF THE INVENTION

One problem concerned with motors of the above type is the rather high sound level emanating from the pressure pulses in the exhaust air leaving the cylinder through the outlet ports in the cylinder. This problem can be and has been dealt with by fitting suitable exhaust silencers. However, silencers often generate further problems due to required extra space, particularly at portable power tools where the available space is very small. Providing an internal silencer, normally in the form of one or more extra expansion volumes, means a larger and more bulky tool housing. Fitting an external silencer means a device protruding from the housing and causing a more awkward handling of the tool.

SUMMARY OF THE INVENTION

It is a main object of the invention to create a pneumatic vane motor of the above mentioned type which generates a substantially reduced exhaust noise without any extra silencer being provided.

Further objects and advantages of the invention will appear from the following specification and claims.

Preferred embodiments of the invention are described below in detail with reference to the accompanying drawings.

DETAILED DESCRIPTION

Figure 1:
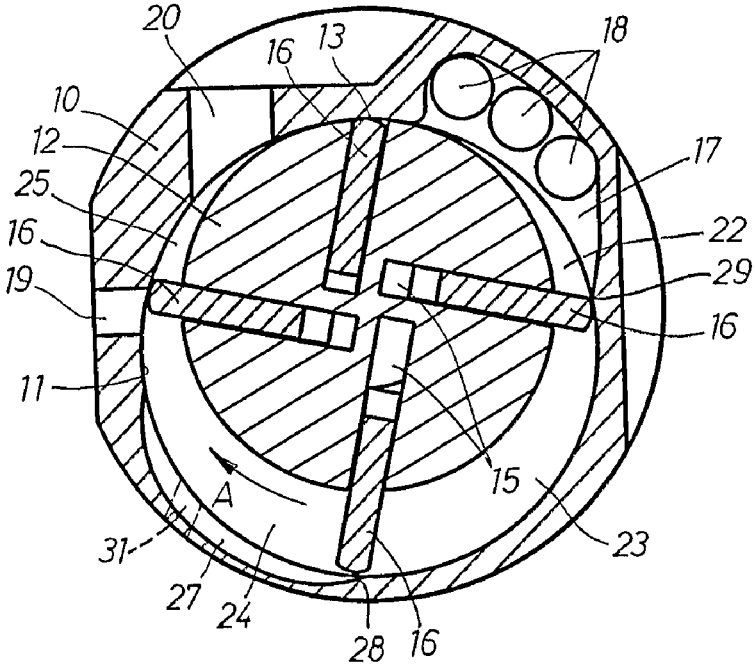
FIG. 1 shows a cross section through a vane motor according to one embodiment of the invention.
Figure 2:
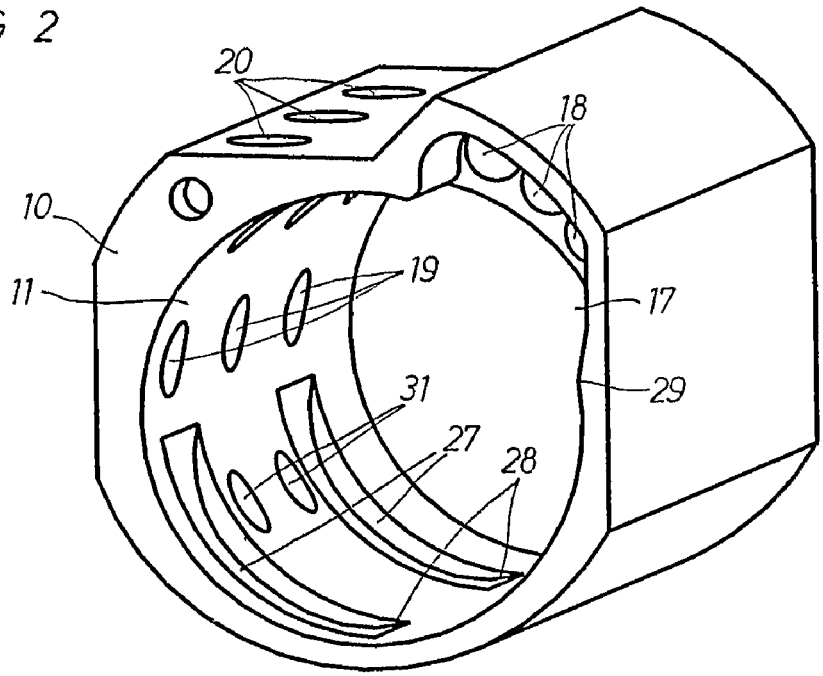
FIG. 2 shows a perspective view of the stator of the motor in FIG. 1.

The motor illustrated in FIGS. 1 and 2 comprises a stator 10 with a cylinder 11, and a rotor 12 journalled in the stator 10 in an eccentric disposition relative to the cylinder 11 such that a clearance seal 13 is formed relative to the cylinder 11. The rotation direction of the rotor 12 is indicated by the arrow A in FIG. 1. The rotor 12 is formed with four slots 15 each carrying a sliding vane 16 arranged to be maintained in constant contact with the cylinder 11 at rotation of the rotor 12. The stator 10 comprises a pressure air inlet opening 17 communicating with a pressure air source via three parallel bores 18 and an air supply valve (not shown), a primary outlet formed by a row of parallel openings 19, and a secondary outlet formed by a row of openings 20.

The vanes 16 define between them four moving cells 22, 23, 24 and 25 each with a varying volume at rotation of the rotor 12. Each cell is confined between a leading vane and a trailing vane, viewed in the direction A of rotation of the rotor 12, and is supplied with pressure air when passing the inlet opening 17. Because of a difference in exposed area on the leading vane and the trailing vane there is obtained a driving force on the rotor 12.

The cylinder 11 is provided with by-pass passages 27 in the form of two parallel grooves each extending in a substantially circumferential direction. Each groove has an opening edge 28, viewed in the rotation direction A of the rotor 12, which is located at a point situated at a distance from the closing edge 29 of the inlet opening 17 corresponding mainly to the width of a cell 22-25, i.e. the peripheral distance between the leading vane and the trailing vane of each cell. In this embodiment of the invention the by-pass passage 27 has its opening edge 28 situated at the point in the cylinder 11 where the vanes 16 have their most extended positions, i.e. diametrically opposite the clearance seal 13. Since the rotor 12 has four vanes distributed at equal angular intervals there is 90 degrees between every two of them, and to prevent pressure air from getting a free passage through the cylinder 11 the angle between the closing edge 29 of the inlet opening 17 and the opening edge 28 of the by-pass passage 27 must exceed 90 degrees.

In the motor illustrated in FIGS. 1 and 2 the cylinder 11 also comprises an initial exhaust air outlet in the form of a row of openings 31 which are located in transverse planes of the motor different from the transverse planes of the passages 27. The openings 31 are located within the angular interval covered by the by-pass passages 27, which means that they are open to the atmosphere as soon as the leading vane of a cell has passed the opening edge 28 of the by-pass passage 27.

Starting with the position of the rotor 12 illustrated in FIG. 1 the operation order of the motor is described as follows:

In this position, the cell 22 is under air pressure from the inlet opening 17 and the continuously open bores 18. The leading vane of cell 22, which is the trailing vane of the preceding cell 23 in the rotation direction A, has just passed the closing edge 29 of the inlet opening 17, whereas the leading vane of the cell 23 has reached the opening edges 28 of the by-pass passages 27. This means that no more pressure air is supplied to the cell 23, and that instead the by-pass passages 27 start connecting the cell 23 to the next cell 24 which has just been opened to the primary outlet 19 by its leading vane. The pressure air in the cell 23 starts evacuating through the cell 24 which will act as an expansion volume with a flow limiting connection with the primary outlet 19.

At continued rotation of the rotor 12 the cell 24 will be drained continuously through the main outlet 19. Further on, the leading vane of the cell will open up also the secondary outlet 20 to ensure a complete draining of the cell.

Returning to the cell 22, the leading vane will have an increasing active area continuously pressurised with pressure air from the inlet opening 17 during its travel through about 90 degrees from the closing edge 29 of the inlet opening 17. After a 90 degree travel, when reaching its most extended position the leading vane of cell 22 approaches the opening edge 28 of the by-pass passages 27. At the same time the trailing vane passes the closing edge 29 of the inlet opening 17, which means that no more pressure air is supplied to the cell 22. The leading vane of the cell 22 will now open up a communication with the preceding cell 23 via the by-pass passages 27 and a draining of the cell 22 will commence. So, each cell uses the preceding cell for a controlled drainage, wherein the preceding cell forms an internal expansion volume with a sound attenuating effect.

Figure 3:
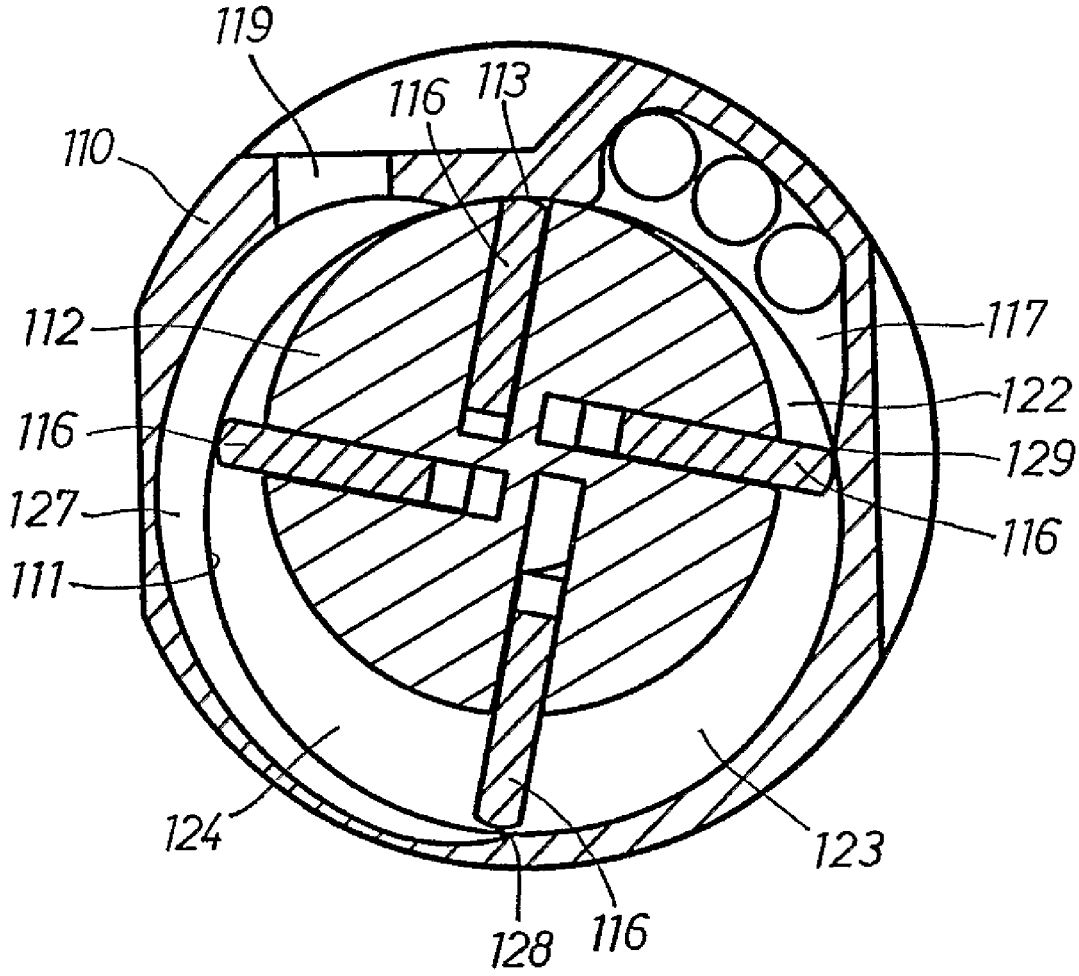
FIG. 3 shows a cross section through a vane motor according to another embodiment of the invention.

The embodiment illustrated in FIG. 3 comprises a stator 110 with a modified cylinder 111 wherein the air outlet comprises just one row of openings 119 which form the main outlet and which are located adjacent the clearance seal 113. The cylinder 111 comprises a by-pass passage 127 which extends over a large angular interval starting with an opening edge 128 situated in the cylinder 111 where the vanes occupy their most extended positions, i.e. diametrically opposite the clearance seal 113 and one cell width from the closing edge 129 of the inlet opening 117. A rotor 112 carries four vanes 116 dividing the cylinder into four moving cells 122-125.

The operation order of this motor is similar to the above described embodiment apart from the fact that pressure air in a working cell 123 will pass two vanes 116, thereby using two preceding cells 124 and 125 for pressure peak reduction and sound attenuation, before reaching the outlet openings 119.

Figure 4:
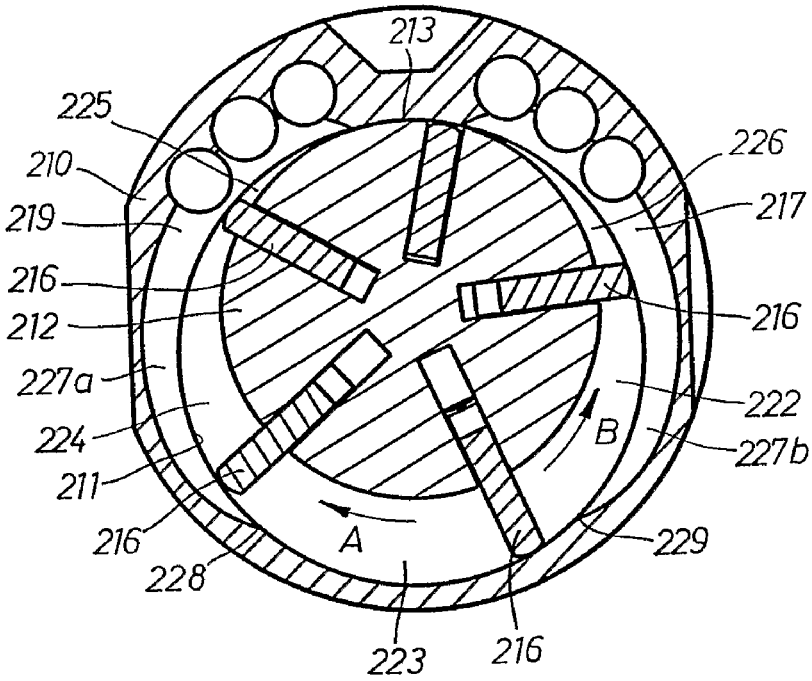
FIG. 4 shows a cross section through a vane motor according to still another embodiment of the invention.
Figure 5:
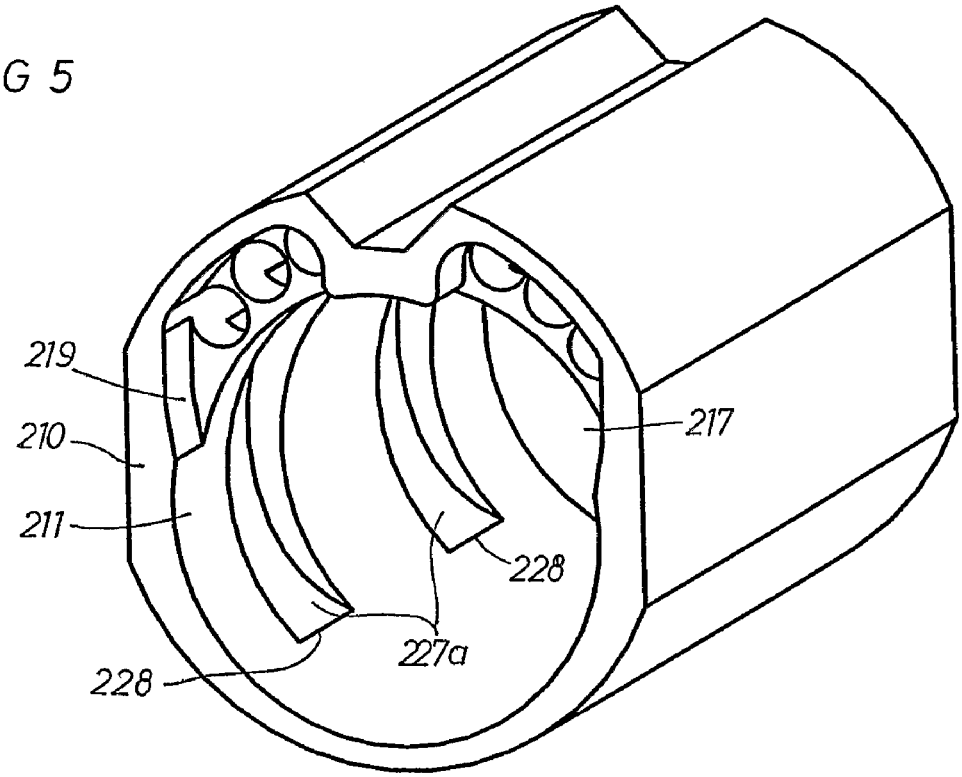
FIG. 5 shows a perspective view of the stator of the motor in FIG. 4.

The motor illustrated in FIGS. 4 and 5, comprises a stator 210 with a cylinder 211 adapted to motor operation in alternative directions A and B. This means that the air inlet opening 217 and the outlet opening 219 are arranged in a symmetric disposition relative to a clearance seal 213 between the rotor 212 and the cylinder 211 and have inverted functions at reverse operation of the motor. In this embodiment of the invention the rotor 212 is provided with five vanes 216 dividing the cylinder 211 into five cells 222-226, which means that the width of each cell is smaller than in the previously described examples including a four cell rotor.

The cylinder 211 is provided with two by-pass passages 227*a* and 227*b* for opening up drainage passages to the very opening acting as an outlet at the moment, depending on the actual direction of motor rotation. At forward rotation A the opening 217 will act as an air inlet and the opening 219 will act as an air outlet, and depending on the by-pass passage 227*b* the opening 217 has a forwardly displaced closing edge 229. The angular distance between the opening edge 228 of the by-pass passage 227*a* and the closing edge 229 of the inlet opening 217 still has to be at least the same as the width of each cell defined by the vanes.

The operation order of this motor will be the same as the previously described examples with a pre-opening of a by-pass leakage before the leading vane of each cell reaches the outlet opening. In this case, however, the direction of rotation can be switched by supplying pressure air to the "outlet" opening 219 and draining exhaust air through the "inlet" opening 217. At reverse operation, the passage 227*a* will act as a part of the air inlet 219, and the by-pass passage 227*b* will serve to leak pressure air to the outlet to accomplish a successive pressure reduction and a sound attenuation.

The invention claimed is:

1. A pneumatic vane motor comprising:

a cylinder with a pressure air inlet opening having a closing edge, and an air outlet opening; and a rotor which is eccentrically journalled in the cylinder and which forms a clearance seal relative to the cylinder, wherein the rotor carries a number of sliding vanes that are disposed at equal angular intervals, and that are arranged to be in constant contact with the cylinder during rotation of the rotor and to divide the cylinder into a number of moving cells each confined between a leading vane and a trailing vane;

wherein the cylinder is provided with at least one by-pass passage extending in a moving direction of the moving cells;

wherein said at least one by-pass passage has an opening edge located mainly in a diametrically opposite position relative to the clearance seal between the rotor and the cylinder;

wherein as the leading vane of a pressurized cell passes said opening edge, said at least one by-pass passage provides air drainage communication past the leading vane of the pressurized cell into an adjacent cell located in front of said pressurized cell in the moving direction of the moving cells; and wherein said adjacent cell communicates with the air outlet opening and forms an internal sound attenuating expansion volume for pressure air leaving said pressurized cell.

2. The pneumatic vane motor according to claim 1, wherein said opening edge is located at a peripheral distance from the closing edge of the pressure air inlet opening corresponding to at least a peripheral distance between the leading vane and the trailing vane of each cell.

* * * * *